US007805090B2

(12) United States Patent
Ferencz, Jr.

(10) Patent No.: US 7,805,090 B2
(45) Date of Patent: Sep. 28, 2010

(54) FUSER ASSEMBLIES, XEROGRAPHIC APPARATUSES AND METHODS OF FUSING TONER ON MEDIA IN XEROGRAPHIC APPARATUSES

(75) Inventor: Gabor Janos Ferencz, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 222 days.

(21) Appl. No.: 12/130,051

(22) Filed: May 30, 2008

(65) Prior Publication Data

US 2009/0297195 A1 Dec. 3, 2009

(51) Int. Cl.
*G03G 15/20* (2006.01)

(52) U.S. Cl. ..... 399/67; 399/328

(58) Field of Classification Search ..... 399/67, 399/88, 320, 324, 328, 329, 336, 341
See application file for complete search history.

(56) References Cited

U.S. PATENT DOCUMENTS 4,001,541 A 1/1977 Hatch et al.
4,698,290 A 10/1987 Berkes
4,788,123 A 11/1988 Berkes et al.
6,148,169 A * 11/2000 Tsukamoto ..... 399/328
6,804,478 B2 * 10/2004 Martin et al. ..... 399/67
6,920,293 B2 * 7/2005 Izawa et al. ..... 399/67
7,147,763 B2 12/2006 Elrod et al.
7,190,917 B2 * 3/2007 Suzumi et al. ..... 399/88
7,305,208 B2 * 12/2007 Inoue et al. ..... 399/328

OTHER PUBLICATIONS

Johan Feenstra and Rob Hayes, Liquavista, "Electrowetting Displays," Jan. 2006, 16 pages.
Frieder Mugele and Jean-Christophe Baret, Institute of Physics Publishing, "Electrowetting: from basics to applications," J. Phys.: Condens. Matter 17 (2005) R705-R774 (69 pages).
Digital Microfluids by Electrowetting, Duke University, Jun. 2004, 5 pages.

* cited by examiner

*Primary Examiner*—Sandra L Brase
(74) *Attorney, Agent, or Firm*—Prass LLP

(57) ABSTRACT

Fuser assemblies, xerographic apparatuses including the fuser assemblies, and methods of fusing toner on media in xerographic apparatuses are disclosed. An embodiment of the fuser assemblies comprises a first roll including an electrically-conductive first surface; an electrically-conductive second surface, the first surface and the second surface defining a nip therebetween at which toner is fused on a medium; at least one voltage sensor for sensing a first voltage difference between the first surface and the second surface; and at least one power supply connected to the first surface and the second surface. A controller is connected to each voltage sensor and each power supply. The controller receives a signal from each voltage sensor indicating the first voltage difference, and the controller controls each power supply to produce a second voltage difference between the first surface and the second surface based on the first voltage difference.

20 Claims, 4 Drawing Sheets

FUSER ASSEMBLIES, XEROGRAPHIC APPARATUSES AND METHODS OF FUSING TONER ON MEDIA IN XEROGRAPHIC APPARATUSES

BACKGROUND

Fuser assemblies, xerographic apparatuses including the fuser assemblies, and methods of fusing toner on media in xerographic apparatuses are disclosed.

Xerographic apparatuses can include a fuser assembly for fusing toner onto media. In these apparatuses, it would be desirable to be able to alter the wetting of media by toner during fusing to affect images formed on the media.

SUMMARY

Fuser assemblies, xerographic apparatuses including the fuser assemblies, and methods of fusing toner on media in xerographic apparatuses are disclosed. An embodiment of a fuser assembly for fusing toner on a medium in a xerographic apparatus comprises a first roll including an electrically-conductive first surface; an electrically-conductive second surface, the first surface and the second surface defining a nip therebetween at which toner is fused on the medium; at least one voltage sensor for sensing a first voltage difference between the first surface and the second surface; and at least one power supply connected to the first surface and the second surface. A controller is connected to each voltage sensor and each power supply. The controller receives a signal from each voltage sensor indicating the first voltage difference, and the controller controls each power supply to produce a second voltage difference between the first surface and the second surface based on the first voltage difference.

DETAILED DESCRIPTION

The disclosed embodiments include fuser assemblies for fusing toner on media in xerographic apparatuses. An embodiment of the fuser assemblies comprises a first roll including an electrically-conductive first surface; an electrically-conductive second surface, the first surface and the second surface defining a nip therebetween at which toner is fused on a medium; at least one voltage sensor for sensing a first voltage difference between the first surface and the second surface; at least one power supply connected to the first surface and the second surface. A controller is connected to each voltage sensor and each power supply. The controller receives a signal from each voltage sensor indicating the first voltage difference, and the controller controls each power supply to produce a second voltage difference between the first surface and the second surface based on the first voltage difference.

The disclosed embodiments further include a fuser assembly comprising a conveyor for conveying a medium; an electromagnetic wave source for irradiating the medium on the conveyor with electromagnetic waves; a first electrical conductor downstream from the electromagnetic wave source along the conveyor, the first electrical conductor having a first surface; a second electrical conductor having a second surface facing the first surface; at least one voltage sensor for sensing a first voltage difference between the first surface and the second surface; and at least one power supply connected to at least one of the first electrical conductor and the second electrical conductor. A controller is connected to each voltage sensor and each power supply. The controller receives a signal from each voltage sensor indicating the first voltage difference, and the controller controls each power supply to produce a second voltage difference between the first surface and the second surface based on the first voltage difference. The conveyor is adapted to convey the medium between the first surface and the second surface.

The disclosed embodiments further include methods of fusing toner on media in a xerographic apparatus. An embodiment of the methods comprises sensing a first voltage difference between an electrically-conductive first surface and an electrically-conductive second surface spaced from the first surface; controlling at least one power supply to supply a second voltage difference between the first surface and the second surface based on the first voltage difference; feeding a medium having molten toner thereon between the first surface and the second surface; and subjecting the medium to the second voltage difference between the first surface and the second surface.

Figure 1:
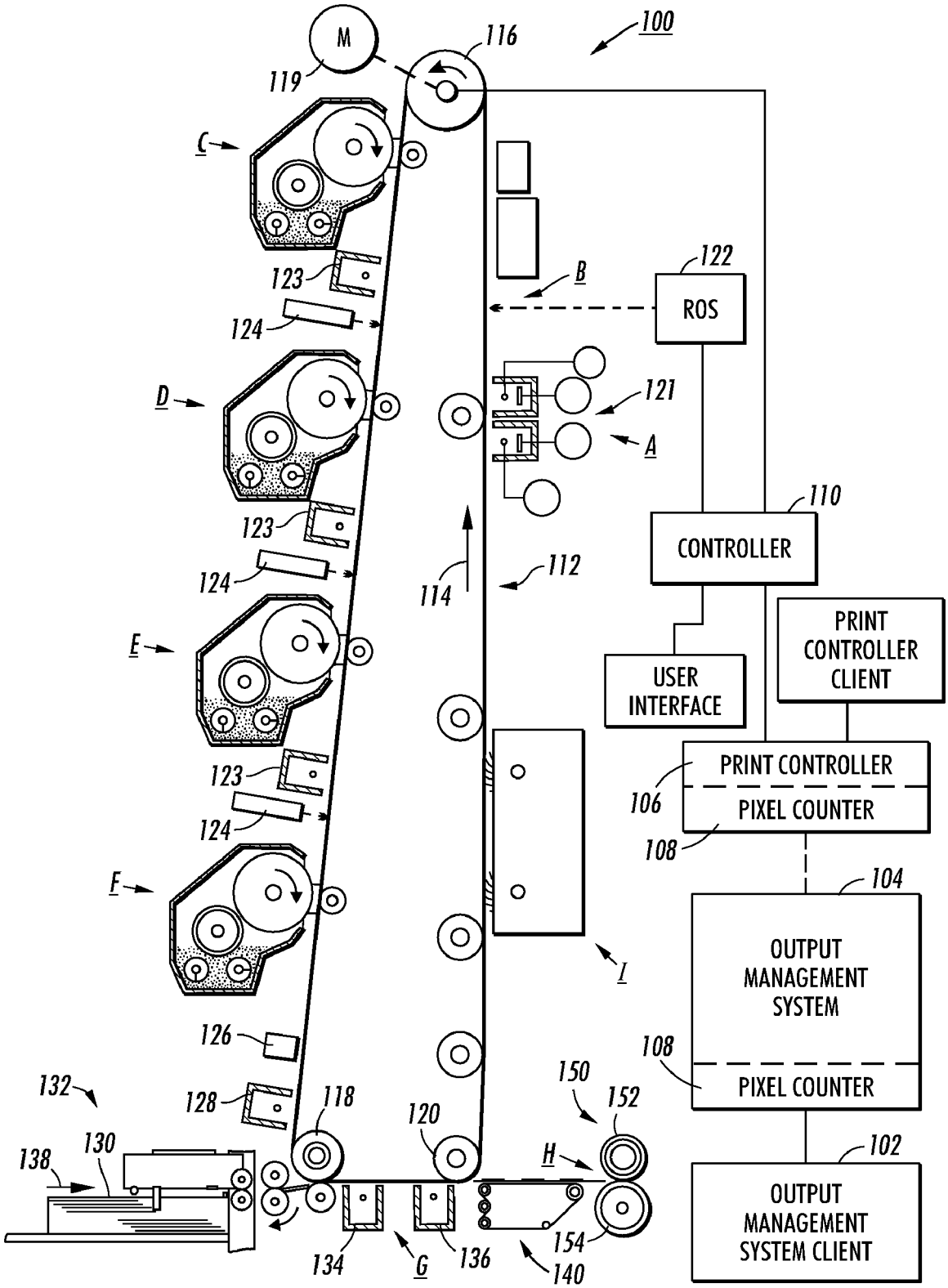
FIG. 1 illustrates an exemplary embodiment of a xerographic apparatus.

FIG. 1 illustrates an exemplary embodiment of a xerographic apparatus 100 in which embodiments of the fuser assemblies can be used. Such xerographic apparatuses are disclosed in U.S. Pat. No. 6,505,832, which is hereby incorporated by reference in its entirety. The xerographic apparatus can produce an image in a single pass of a photoreceptor belt. Embodiments of the fuser assemblies can be used in other imaging systems as well, such as in multiple-pass color process systems, single- or multiple-pass highlight color systems, or black and white printing systems.

In the xerographic apparatus 100 shown in FIG. 1, printing jobs can be submitted from an output management system client 102 to an output management system 104. The output management system 104 can supply printing jobs to a print controller 106. Job control information is sent from the print controller 106 to a controller 110. A pixel counter 108 included in the output management system 104 counts the number of pixels to be imaged with toner on each sheet of the print job, for each color. The pixel count information is stored in the output management system 104.

The xerographic apparatus 100 includes a continuous (endless) photoreceptor belt 112 supported on rolls 116, 118 and 120. The drive roll 116 is connected to a drive motor 119 operable to move the photoreceptor belt 112 in the direction of arrow 114 through the xerographic stations.

During the printing process, a portion of the photoreceptor belt 112 passes through a charging station A including a corona generating device 121, which charges the photoconductive surface of photoreceptor belt 112.

Next, the charged, photoconductive surface of the photoreceptor belt 112 is advanced through an imaging/exposure station B. At the imaging/exposure station B, the controller 110 receives image signals from the print controller 106 for the desired output image, and converts these signals to signals transmitted to a laser raster output scanner (ROS) 122. When exposed at the exposure station B, the photoreceptor belt 112 is discharged to include charged areas, and discharged or developed areas.

At a first development station C, charged toner particles, e.g., black particles, are attracted to the electrostatic latent image on the photoreceptor belt 112. The developed image is then transported past a second charging device 123 at which the photoreceptor belt 112 and developed toner image areas are recharged.

A second exposure/imaging is performed by device 124, which selectively discharges the photoreceptor belt 112 on toned areas and/or bare areas, based on the image to be developed with the second color toner. As a result, the photoreceptor belt 112 contains toned and untoned areas at relatively high voltage levels, and toned and untoned areas at relatively low voltage levels representing image areas. At the second developer station, D, a negatively-charged, developer material comprising, e.g., yellow toner, is transferred to the latent images on the photoreceptor belt 112 using a second developer system.

The above procedure is repeated for a third image for a third color toner, such as magenta, at station E, and for a fourth image and color toner, such as cyan, at station F. As a result, a full-color, composite toner image is developed on the photoreceptor belt 112. A mass sensor 126 can measure developed mass per unit area.

In cases where some toner charge is totally neutralized, or the polarity reversed, a negative pre-transfer dicorotron member 128 can condition the toner for transfer to a medium using positive corona discharge.

A medium 130 (e.g., a sheet of paper) is advanced to transfer station G by a sheet feeding apparatus 132. The medium 130 is brought into contact with the photoreceptor belt 112 so that the toner powder image developed on the photoreceptor belt 112 contacts the advancing medium 130.

The transfer station G includes a transfer dicorotron 134, which sprays positive ions onto the backside of the medium 130. The ions attract the negatively-charged toner powder images from the photoreceptor belt 112 to the medium 130. A detack dicorotron 136 facilitates stripping of media from the photoreceptor belt 112.

The medium continues to advance, in the direction of arrow 138, onto a conveyor 140. The conveyor 140 advances the medium to a fusing station H. The fusing station H includes a fuser assembly 150 for permanently affixing, i.e., fusing, the transferred powder image to the medium 130. The illustrated fuser assembly 150 includes a heated fuser roll 152 and a pressure roll 154. The medium 130 is advanced between the fuser roll 152 and pressure roll 154 with the toner powder image contacting the fuser roll 152, causing the toner powder images to be permanently affixed to the medium 130. The medium 130 is then guided to an output device (not shown) for removal from the apparatus by the operator.

After the medium 130 has been separated from the photoreceptor belt 112, residual toner particles are removed from the photoreceptor belt 112 at a cleaning station 1.

Figure 2:
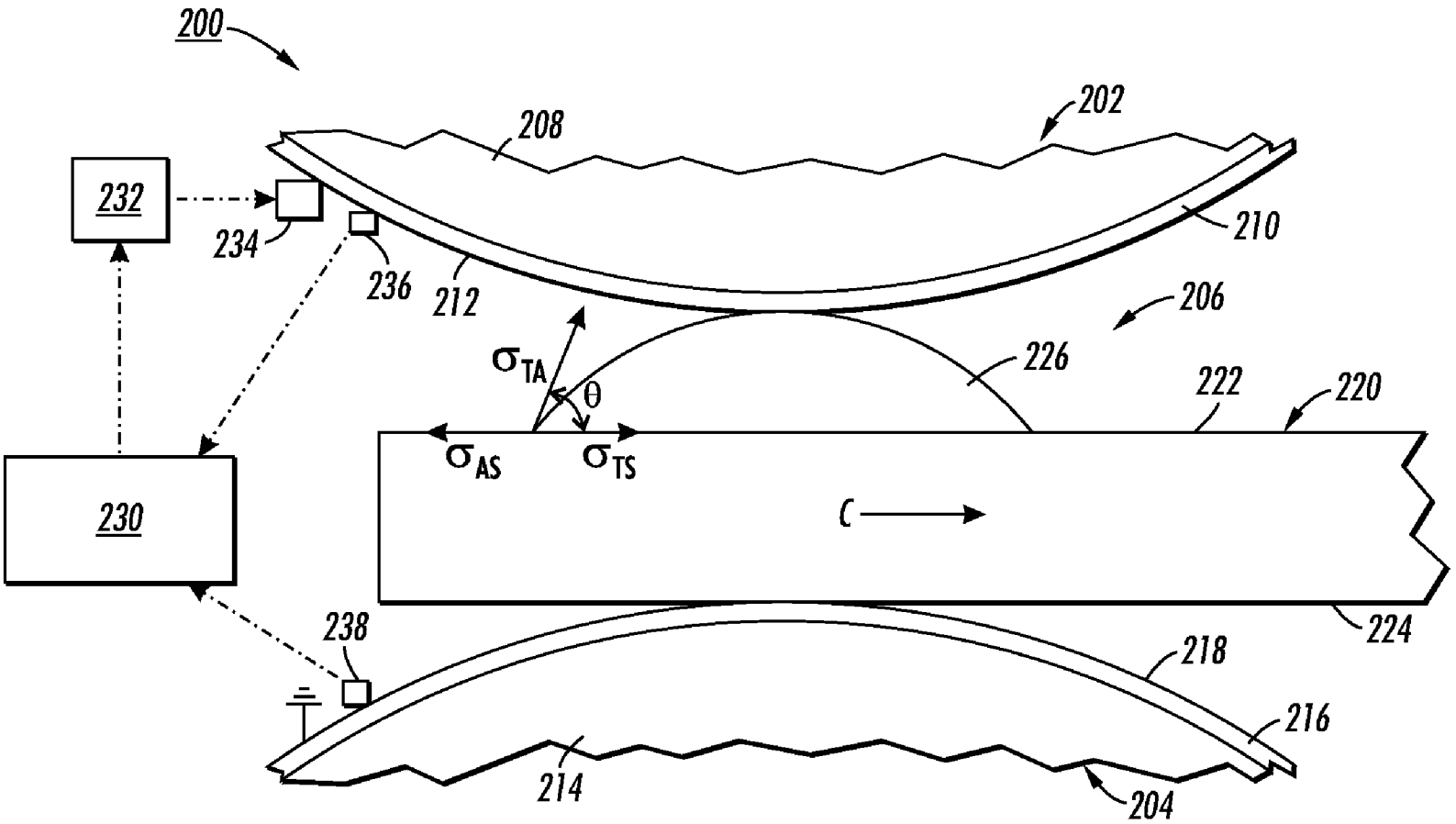
FIG. 2 illustrates an exemplary embodiment of a fuser assembly including a pressure roll and a fuser roll.

FIG. 2 illustrates a portion of an exemplary embodiment of a fuser assembly 200, which is constructed to allow the control of wetting of media (e.g., paper sheets and other print media) by toner during fusing. The media can have various lengths and widths. The fuser assembly 200 can be used in different types of xerographic apparatuses. For example, the fuser assembly 200 can be incorporated in the xerographic apparatus 100 shown in FIG. 1, in place of the fuser assembly 150.

As shown in FIG. 2, the fuser assembly 200 includes a fuser roll 202, a pressure roll 204, and a nip 206 between the fuser roll 202 and pressure roll 204. The fuser roll 202 and pressure roll 204 are cylindrical shaped. The fuser roll 202 includes a core 208 and an outer layer 210 surrounding the core 208 and forming an outer surface 212 of the fuser roll 202. The pressure roll 204 includes a core 214 and an outer layer 216 surrounding the core 214 and forming an outer surface 218 of the pressure roll 204. A medium 220 having opposed surfaces 222, 224 is shown after being fed to the nip 206 between the surface 212 and the surface 218. The medium 220 is conveyed through the nip 206 in the direction of arrow C. Toner 226 is shown on the surface 222 of the medium 220. Typically, the pressure roll 204 conforms slightly to the fuser roll 202, and the closest distance between the surface 212 and the surface 218 is approximately equal to the combined thickness of the medium 220 and the toner 226. This combined thickness can typically be about 0.1 mm to about 4 mm.

The core 208 of the fuser roll 202 is typically comprised of metal. The outer layer 210 can include one or more separate layers. For the outer layer 210, the sole layer of a single-layer structure, or the outer-most layer of a multi-layer structure, is comprised of a thermally-conductive material. It is desirable that this material have non-stick properties to reduce adherence of toner to the surface 212 during fusing of toner on the medium 220. An exemplary material that can be used to form the outer layer 210 is silicone containing an electrically-conductive material, such as carbon particles, fibers or the like, to provide the desired electrical properties in the outer layer 210.

The fuser roll 202 includes one or more internal heating elements for heating the outer layer 210. These heating elements can be heat lamps (e.g., tungsten quartz lamps), heating rods (e.g., quartz rods), or the like, which are located in a hollow, cylindrical-shaped space inside of the core 208 of the fuser roll 202. The heating elements are connected to a power supply for powering the heating elements. The power supply can be connected to a fuser controller. The heating elements can heat the surface 212 uniformly to a temperature effective to heat the medium 220 to fuse the toner 226 on the surface 222 at the nip 206.

The core 214 of the pressure roll 204 is comprised of a solid material, such as steel, or the like. The outer layer 216 is comprised of an electrically-conductive elastomer. For example, the outer layer 216 can be comprised of rubber, such as silicone rubber, and contain an effective amount of an electrically-conductive filler material, such as carbon particles, fibers or the like, to provide the desired electrical properties in the outer layer 216. The pressure roll 204 is typically unheated.

As shown in FIG. 2, the fuser assembly 200 includes a controller 230 connected to a power supply 232. The controller 230 controls the operation of the power supply 232. In the embodiment, an electrical conductor 234 contacts the surface 212 of the fuser roll 202. The power supply 232 is connected to the electrical conductor 234. The surface 218 of the pressure roll 204 is at ground potential. In other embodiments, an electrical conductor (not shown) can contact the surface 218, and the surface 212 can be at ground potential. In such embodiments, a power supply can be connected to the electrical conductor in contact with the surface 218 and to the controller 230. In other embodiments, the electrical conductor 234 can be in contact with the surface 212, and another electrical conductor can be in contact with the surface 218. In such embodiments, a separate power supply (not shown) can be connected to the electrical conductor contacting the surface 218 and also to the controller 230. The electrical conductor 234 includes an electrically-conductive material contacting the surface 212. For example, the electrical conductor 234 can include a metallic brush. The electrically-conductive material is desirably non-abrasive with respect to the surface 212, which rotates relative to the electrical conductor 234.

In embodiments, the fuser assembly 200 includes a voltage sensor 236 for sensing the voltage on the surface 212 of the fuser roll 202, and a voltage sensor 238 for sensing the voltage on the surface 218 of the pressure roll 204. The voltage sensors 236, 238 are connected to the controller 230. The controller 230 receives signals from the voltage sensors 236, 238, indicating the voltage on the respective surfaces 212, 218. In embodiments, the controller 230 can be programmed to interrogate the voltage sensors 236, 238 before a medium is fed to the nip 206, which can be detected in the xerographic apparatus. The voltage difference between the surfaces 212, 218 is determined by the controller 230.

In other embodiments, the fuser assembly 200 can include a single differential voltage sensor connected to the controller 230 for sensing the voltage on the surface 212 and also the voltage on the surface 218. The differential voltage sensor sends an output signal to the controller 230 indicating the voltage difference between the surface 212 and the surface 218.

During operation of the fuser assembly 200, the medium 220 with at least one toner image (e.g., text and/or other image type) on the surface 222 is fed to the nip 206 by a sheet feeding apparatus of the xerographic apparatus, such as by the sheet feeding apparatus 132 shown in FIG. 1. At the nip 206, the surface 212 of the rotating fuser roll 202 contacts the surface 222 of the medium 220, and the opposite surface 224 of the medium 220 contacts the surface 218 of the pressure roll 204. The fuser roll 202 and pressure roll 204 apply heat and pressure to the medium 220 to cause the toner 226 to melt, coalesce and penetrate into the medium 220, i.e., into paper fibers, at the surface 222, to fuse the toner 226 on the medium 220. The fusing temperature used for fusing the toner 226 on the medium 220 is based on factors including the thickness of the medium 220 and whether the medium 220 is coated or uncoated. The fusing temperature is typically about 150° C. to about 160° C. The gloss of images formed on the surface 222 can be controlled by the applied temperature and pressure, as well as by the length of time that the medium 220 remains in the nip 206.

In FIG. 2, the toner 226 is shown as a molten droplet. As shown, there are a surface tension, $\sigma_{TS}$, at the interface between the toner 226 and the medium 220; a surface tension, $\sigma_{AS}$, at the interface between the air and the medium 220; and a surface tension, $\sigma_{TA}$, at the interface between the toner and the air. The molten toner 226 forms a contact angle, θ, which is defined between $\sigma_{TA}$ and $\sigma_{TS}$. The surface tensions $\sigma_{TS}$, $\sigma_{AS}$ and $\sigma_{TA}$ are material constants, which depend on the materials of the medium 220 and toner 226. In embodiments, release oil can be applied on the surface 222 of the medium 220. In such embodiments, the surface tension, $\sigma_{AS}$, is between the oil and the medium 220, and the surface tension, $\sigma_{TA}$, is between the toner and the oil.

In embodiments, a selected voltage can be supplied to the surface 212 of the fuser roll 202 by the power supply 232. The voltage difference between the surface 212 and the surface 218 of the pressure roll 204 can be selected to decrease the contact angle θ shown in FIG. 2. Consequently, the toner 226 spreads and increases wetting of the surface 222. This modification of the wetting properties of a solid material is known as electrowetting. The increased wetting of the surface 222 can be used to enhance fixing of the toner 226 on the surface 222.

In other embodiments, the power supply 232 can supply a selected voltage to the surface 212 to cause the toner 226 to substantially retain its shape, i.e., not spread on the surface 222. Accordingly, the voltage difference between the surface 212 and the surface 218 can be selected to substantially, or completely, preserve the dot structure of the toner 226, by controlling wetting of the surface 222 by the toner 226.

For the droplet of toner 226 supported on the surface 222 of the medium 220 shown in FIG. 2, Young's equation for interfacial equilibrium conditions can be applied to produce the following balance in the horizontal components of the three surface tensions:

$$\sigma_{TA}\cos\theta=\sigma_{AS}-\sigma_{TS} \tag{1}$$

See, e.g., F. Mugele and J. C. Baret, "Electrowetting: from basics to applications," *J. Phys.: Condens. Matter* 17, pp. 705-774 (2005).

For electrowetting, where a liquid droplet is supported on a solid electrical insulating material insulating the droplet from an electrode, an electrostatic term is added to the right side of equation (1), as follows:

$$\sigma_{TA}\cos\theta'=\sigma_{AS}-\sigma_{TS}+[(\in_0\in/2d)\cdot V^2], \tag{2}$$

where $\in_0$ is the permittivity of empty space (i.e., approximately 1); $\in$ is the permittivity of the electrical insulator material supporting the droplet; d is the distance between the opposed electrical conductors at different voltages; and V is the voltage difference between the electrodes. See, e.g., J. Feenstra and R. Hayes, "Electrowetting Displays," Liquavista BV, pp. 1-16 (January 2006); and F. Mugele and J. C. Baret, "Electrowetting: from basics to applications," *J. Phys.: Condens. Matter* 17, pp. 705-774 (2005). The permittivity, $\in$, is given by the relationship: $\in=k\cdot\in_0$, where k is the dielectric constant of the insulator material.

Equation (2) can be rewritten, as follows:

$$\cos\theta'=\cos\theta+[(\in_0\in/2d\sigma_{TA})\cdot V^2]. \tag{3}$$

According to Equation (3), the voltage (i.e., voltage difference), V, between the electrodes increases the magnitude of cos θ', thereby decreasing the contact angle θ'. Consequently, the voltage, V, increases wetting of the solid surface by the liquid droplet.

The values of $\in$, d and $\sigma_{TA}$ for the fuser assembly 200, medium 220 and toner 226 can be input to the controller 230 via a system bus, or the like. The system bus can also input the desired toner contact angle θ' to the controller 230. The controller 230 can determine the value of V that can be applied to the medium 230 to produce the desired toner contact angle θ'.

In the fuser assembly 200, the voltage sensor 236 senses the voltage on the surface 212 of the fuser roll 202, and the voltage sensor 238 senses the voltage on the surface 218 of the pressure roll 204. The voltage sensors 236, 238 send output signals to the controller 230 indicating the values of the voltages. Depending on whether it is desirable to alter wetting of the surface 222 of the medium 220 by the toner 226, or alternatively to maintain the shape of the toner (i.e., not enhance wetting of the medium more than that which results from applying temperature and pressure to the toner at the nip 206 via the surfaces 212, 218), a selected voltage is supplied to the electrical conductor 234 by the power supply 232. Typically, the magnitude of the voltage, V, can range from about 0 V to about 36 V.

If a voltage is being passively applied to at least one of the surfaces 212, 218 by a source other than the power supply 232 (e.g., an electrostatic source) as sensed by the voltages sensors 236, 238, the controller 230 can control the power supply 232 to supply a countering voltage to the electrical conductor 234, which voltage has a magnitude effective to compensate for the passively-applied voltage. For example, if the passively-applied voltage has a magnitude of x volts, the controller 230 can control the power supply 232 to supply −x volts to the electrical conductor 234 to completely negate the passively-applied voltage. The controller 230 can control the power supply 232 to remove the effect of such a passively-applied voltage present on the surfaces 212, 218, which may be uncontrolled under normal operating conditions. In other embodiments, it may be sufficient to only partially remove the passively-applied voltage on the surfaces 212, 218. For example, the controller 230 can control the power supply 232 to supply a negative voltage having a smaller absolute value than that of the passively-applied voltage.

In other embodiments in which it is desired to alter wetting of the surface 222 by the toner 226, a selected voltage can be applied to the electrical conductor 234 by the power supply 232 to enhance wetting. For example, if the selected voltage, V, is 5× volts, and there is a passively-applied voltage of x volts detected by the voltage sensors 236, 238, the controller 230 can control the power supply 232 to supply an additional 4× volts to produce the desired voltage of 5× volts between the surfaces 212, 218.

In embodiments, the controller 230 can control the power supply 232 to supply a voltage to the electrical conductor 234 to control wetting of toner over only a portion of the surface 222 of the medium 220, or over the entire surface 222, depending on the desired image(s) to be produced on the surface 222. For example, wetting of the toner on the surface 222 of the medium 220 can be altered to affect glossiness and/or coarseness of images. Wetting can be increased to increase glossiness, or not altered to produce matte finishes. Typically, it is desirable to have uniform gloss across the surface 222. In such embodiments, the applied voltage can be applied to the entire surface 222 of the medium 220. Wetting can be controlled at the leading edge and/or trailing edge of the medium 220 to control printing at these edges, by applying the voltage difference to the leading and/or trailing edges of the medium 220. In some embodiments, it may be desirable to have more or less wetting at the leading and/or trailing edge than at the center of the medium 220. The voltage applied between the surfaces 212, 218 can more effectively control the shape of the molten toner droplets at portions of the surface 222 of the medium 220 that are subjected to less pressure than other portions of the surface 222, e.g., near the leading edge and/or trailing edge of the medium 220.

As shown in Equation (3), the magnitude of cos θ' can be increased by increasing ∈ (i.e., increasing the dielectric constant, k), increasing V and/or decreasing d. The dielectric constant, k, of dry paper is typically about 1.5 to 3, and coated paper typically has a k value of about 2.5 to 4. In the embodiment of the fuser assembly 200 shown in FIG. 2, the distance between the curved surface 212 of the fuser roll 202 and the curved surface 218 of the pressure roll 204 varies along the length dimension of the medium 220 (i.e., in direction C). As the pressure roll 204 conforms slightly, as an approximation, the outer layer 210 of the fuser roll 202 and the outer layer 216 of the pressure roll 204 can be considered to be parallel plates in the region of the nip 206. According to this approximation, the surface 212 and the surface 218 are considered to have a constant separation distance, d, in the region of the nip 206 where the toner is subjected to heat, pressure and voltage, and are modeled as a parallel-plate capacitor.

Figure 3:
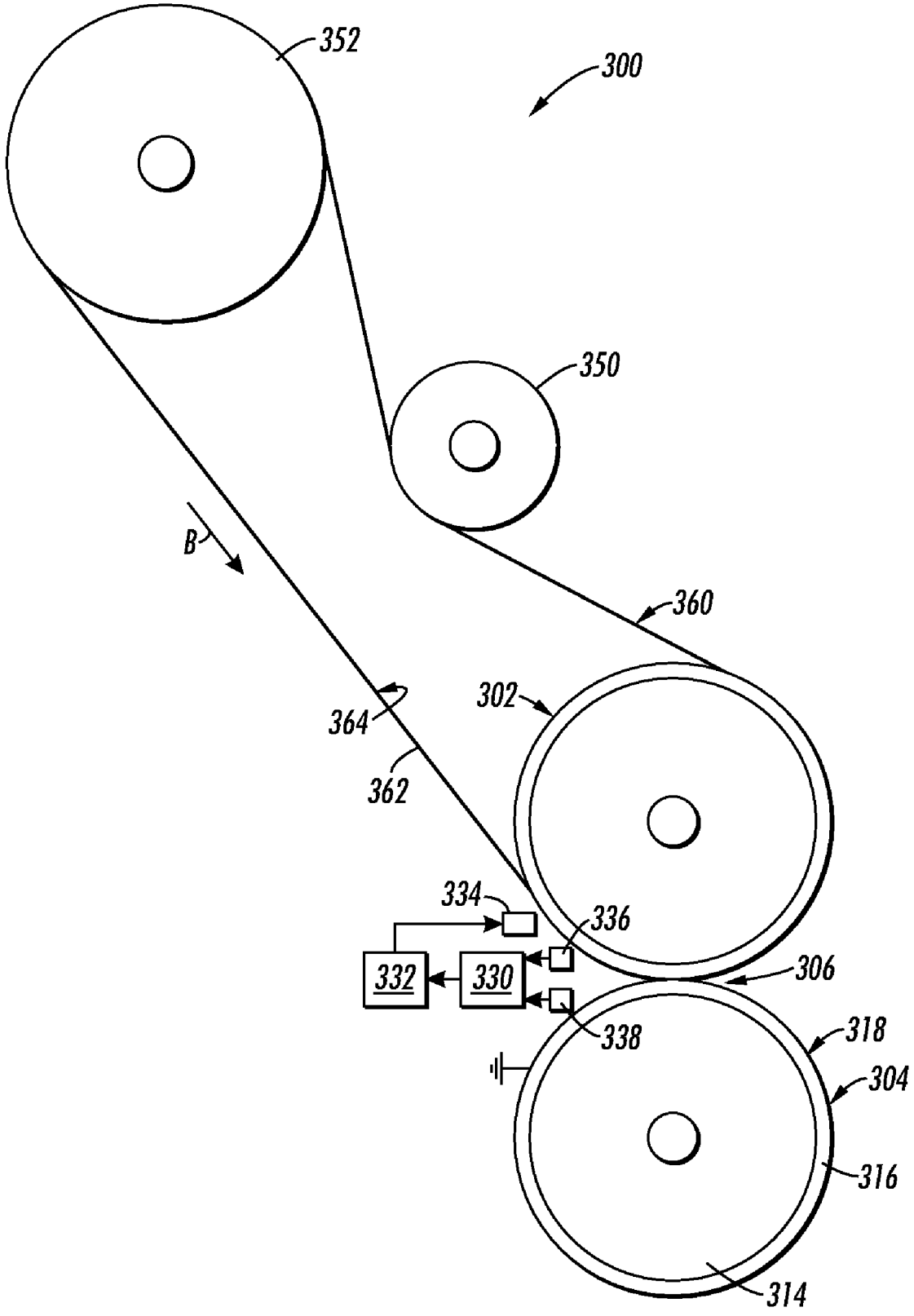
FIG. 3 illustrates an exemplary embodiment of a fuser assembly including a pressure roll and a fuser belt.

FIG. 3 shows a portion of another exemplary embodiment of a fuser assembly 300. The fuser assembly 300 can be used in different types of xerographic apparatuses. For example, the fuser assembly 300 can be incorporated in the xerographic apparatus 100 shown in FIG. 1, in place of the fuser assembly 150.

As shown in FIG. 3, the fuser assembly 300 includes a fuser roll 302; a pressure roll 304; a nip 306 between the fuser roll 302 and pressure roll 304; a belt roll 352 and a tensioning roll 350 between the fuser roll 302 and belt roll 352. An endless (continuous) fuser belt 360 is supported on the fuser roll 302, belt roll 352, and tensioning roll 350. The fuser belt 360 includes an outer surface 362 and an inner surface 364. The fuser belt 360 is driven to rotate in the counter-clockwise direction as indicated by arrow B by a suitable mechanism, such as a stepper motor (not shown).

In the fuser assembly 300, at least the fuser roll 302 is internally heated. The belt roll 352 and/or tensioning roll 350 can typically also be internally heated. The fuser roll 302, belt roll 352 and/or tensioning roll 350 can include one or more internal heating elements, such as heat lamps (e.g., tungsten quartz lamps), heating rods (e.g., quartz rods), or the like, which are connected to a power supply for powering the heating elements. The heated fuser roll 302 (and optionally also the belt roll 352 and/or tensioning roll 350) heats the inner surface 364 of the fuser belt 360 by conduction. The amount of heat supplied to the fuser belt 360 by the heated roll(s) is based on the temperature set point for the fuser belt 360. The temperature set point is based on the type of media to be printed using the heated fuser belt 360. For example, higher temperature set points are typically used for thicker and/or coated media than for thinner or uncoated media.

An exemplary embodiment of the fuser belt 360 comprises a base layer of polyimide, or the like; and a layer of silicone on the base layer. An optional release layer can be provided on the silicone layer. Typically, the base layer has a thickness of about 50 μm to about 100 μm, the silicone layer has a thickness of about 160 μm to about 300 μm, and the optional outer layer has a thickness of about 20 μm to about 40 μm. The silicone layer and/or the optional outer layer can contain an effective amount of an electrically-conductive filler material, such as carbon particles or fibers, to provide the desired electrical conductivity in the outer-most layer of the fuser belt 360.

Embodiments of the fuser belt 360 can have a length of at least about 500 mm, such as at least about 600 mm, 700 mm, 800 mm, 900 mm, 1000 mm, or even longer. The primary failure modes of belt fusers are typically attributed to the life of the fuser belt. Using a longer fuser belt for embodiments of the fuser belt 360 provides more surface area available for wear than shorter belts have, and can increase the service life of the fuser belt 360.

As shown in FIG. 3, the fuser assembly 300 includes a controller 330 connected to a power supply 332. An electrical conductor 334 contacts the outer surface 362 of the fuser belt 360, and is connected to the power supply 332. In the embodiment, the surface 318 of the pressure roll 304 is at ground potential. In other embodiments, an electrical conductor (not shown) can contact the surface 318, and the surface 362 can be at ground potential. In such embodiments, a power supply can be connected to the electrical conductor contacting the surface 318 and to the controller 330. In other embodiments, the electrical conductor 334 can be in contact with the surface 362 and another electrical conductor can contact the surface 318. In such embodiments, a separate power supply (not shown) can be connected to the electrical conductor in contact with the surface 318, and to the controller 330, with the electrical conductor 334 being connected to the power supply 332. The electrical conductor 334 includes an electrically-conductive material contacting the outer surface 362 of the fuser belt 360. The electrically-conductive material is desirably non-abrasive with respect to the outer surface 362, which rotates relative to the electrical conductors 334.

The fuser assembly 300 includes a voltage sensor 336 for detecting the voltage on the outer surface 362 of the fuser belt 360, and a voltage sensor 338 for detecting the voltage on the surface 318 of the pressure roll 304. The voltage sensors 336, 338 are connected to the controller 330.

In other embodiments, the fuser assembly 300 can include a single differential voltage sensor connected to the controller 330 for sensing the voltage on the surface 362 and also the voltage on the surface 318. The differential voltage sensor sends an output signal to the controller 330 indicating the voltage difference between the surface 362 and the surface 318.

During operation of the fuser assembly 300, a medium (not shown) with one or more toner images is fed to the nip 306 by a sheet feeding apparatus. At the nip 306, the outer surface 362 of the rotating fuser belt 360 contacts one surface of the medium and the rotating surface 318 of the pressure roll 304 contacts the opposite surface of the medium. The fuser belt 360 and pressure roll 304 apply sufficient heat and pressure to the medium to cause the toner to melt, coalesce and penetrate into the medium, to fuse the toner on the medium. The fusing temperature used for fusing the toner on media is selected based, e.g., on the thickness of the medium and whether the medium is coated or uncoated. The gloss of images formed on the medium can be controlled by the applied temperature and pressure, and the length of time that the toner remains in the nip 306.

In the fuser assembly 300, the voltage sensors 336, 338 sense the voltage on the outer surface 362 of the fuser belt 360 and the surface 318 of the pressure roll 304, respectively, and send corresponding signals to the controller 330. In embodiments, the controller 330 can be programmed to interrogate the voltage sensors 336, 338 before a medium is fed to the nip 306. The controller 330 determines the voltage difference between the outer surfaces 362, 318. Depending on whether it is desirable to alter wetting of the medium by the toner, or alternatively to maintain the shape of the toner (i.e., not enhance wetting of the medium more than that resulting from the application of temperature and pressure to the toner at the nip 306), a selected voltage is supplied to the electrical conductor 334 by the power supply 332.

The controller 330 can control the power supply 332 to supply a voltage to the electrical conductor 334 to control wetting of toner over only a portion of the surface of the medium 322, or over the entire surface, depending on the desired image(s) to be produced on the medium. For example, wetting of the toner on the medium can be altered to affect glossiness and/or coarseness of images. Wetting can be increased to increase glossiness, or not altered to produce matte finishes. By controlling the portion of the medium exposed to the voltage difference, wetting can be controlled at the leading and/or trailing edge of the medium to control printing at these edges. In some embodiments, it may be desirable to have more or less wetting at the leading and/or trailing edge than at the center of the medium.

Figure 4:
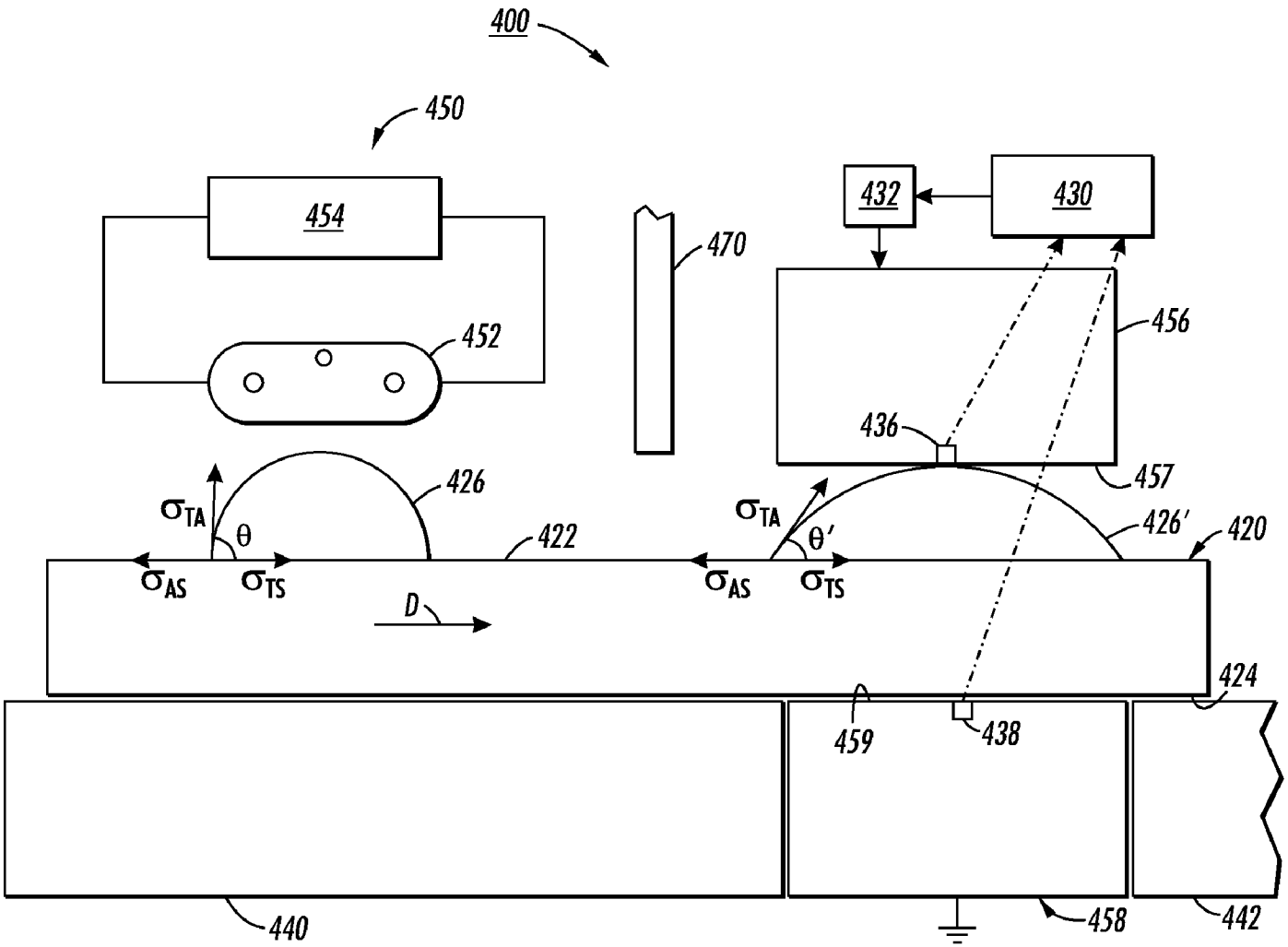
FIG. 4 illustrates an exemplary embodiment of a fuser assembly including a non-contact fusing system.

FIG. 4 shows an exemplary embodiment of a fuser assembly 400 including a non-contact fusing system 450 for melting toner onto media. The fuser assembly 400 can be used in different types of xerographic apparatuses. For example, the fuser assembly 400 can be incorporated in the xerographic apparatus 100 shown in FIG. 1, in place of the fuser assembly 150.

As shown in FIG. 4, in the embodiment, the non-contact fusing system 450 includes an electromagnetic (EM) wave source 452, which does not directly contact the medium 420. As shown, the fuser assembly 400 includes a conveyor 440, 442 for conveying the medium 420 having opposed surfaces 422, 424 in the direction indicated by arrow D. A molten droplet of toner 426 is shown on the surface 422 adjacent the electromagnetic wave source 452. The electromagnetic wave source 452 is connected to a controller 454.

In embodiments, the electromagnetic wave source 452 is a flash lamp adapted to emit radiant energy that can be absorbed by pigments or dyes contained in the toner 426. The absorbed radiant energy is converted to thermal energy by the toner, enabling heat generation and fusing of the toner particles. In embodiments, it is desirable that the electromagnetic wave source 452 be constructed to emit radiation over a wavelength range that can be efficiently absorbed by the toner 426 without also being significantly absorbed by the material of the medium 420 (e.g., paper). The electromagnetic wave source 452 can be rapidly flashed to irradiate and melt toner that absorbs the emitted wavelengths. The medium 420 is not significantly heated by the radiant energy emitted by the electromagnetic wave source 452 due to the low absorptivity of the material of the medium 420 with respect to the incident radiation. Exemplary flash fusing systems and processes for fusing toner on media are described in U.S. Pat. Nos. 4,698,290 and 4,788,123, each of which is hereby incorporated by reference in its entirety. Typically, the emitted wavelength range for flash fusing systems is about 700 nm to about 1500 nm.

In other embodiments, the electromagnetic wave source 452 of the non-contact fusing system 450 is a radiant fusing system. The radiant fusing system emits electromagnetic waves, which are absorbed by, and thereby significantly heat, the medium and the toner to cause melting of the toner.

As shown in FIG. 4, there are a surface tension, $\sigma_{TS}$, at the interface between the toner 426 and the medium 420; a surface tension, $\sigma_{AS}$, at the interface between the air and the medium 420; and a surface tension, $\sigma_{TA}$, at the interface between the toner and the air. The molten toner 426 forms a contact angle, $\theta$, which is defined between $\sigma_{TA}$ and $\sigma_{TS}$.

As shown in FIG. 4, downstream along the conveyor 440, 442 from the electromagnetic wave source 452, the fuser assembly 400 includes electrical conductors 456, 458; a voltage sensor 436 for detecting the voltage on the surface 457 of the electrical conductor 456 facing the surface 422 of the medium 420; and a voltage sensor 438 for detecting the voltage on the surface 459 of the electrical conductor 458 facing the surface 424 of the medium 420. The surfaces 457, 459 face each other. The electrical conductors 456, 458 can be metal plates, for example. In the embodiment, the electrical conductor 458 is at ground potential. In other embodiments, the electrical conductor 456 can be at ground potential, and a power supply can be connected to the electrical conductor 458.

The voltage sensors 436, 438 are connected to a controller 430. A power supply 432 is connected to the controller 430. In embodiments, an additional power supply (not shown) can be connected to the electrical conductor 458 and the controller 430.

In other embodiments, the fuser assembly 400 can include a single differential voltage sensor connected to the controller 430 for sensing the voltage on the surface 457 and also the voltage on the surface 459. The differential voltage sensor sends an output signal to the controller 430 indicating the voltage difference between the surface 457 and the surface 459.

In the embodiment, electromagnetic shielding material 470 is disposed between the electromagnetic wave source 452 and the electrical conductors 456, 458 to reduce interference between the EM waves emitted by the electromagnetic wave source 452, and the electric field produced between the electrical conductors 456, 458.

During operation of the fuser assembly 400, the voltage sensor 436 senses the voltage on the surface 457 of the electrical conductor 456, and the voltage sensor 438 senses the voltage on the surface 459 of the electrical conductor 458. The voltage sensors 436, 438 send corresponding signals to the controller 430, which determines the voltage difference between the surfaces 457, 459. Depending on whether it is desirable to alter wetting of the medium 420 by the toner, or alternatively to maintain the shape of the toner (i.e., not enhance wetting), a selected voltage can be supplied to the electrical conductor 456 by the power supply 432, and the medium can be subjected to the resulting electric field.

FIG. 4 shows a droplet of toner 426' that has been subjected to a voltage difference, V, generated between the electrical conductors 456, 458 by the power supply 432. According to Equation (3), the voltage difference increases the magnitude of cos θ', thereby decreasing the contact angle θ' defined between $\sigma_{TA}$ and $\sigma_{TS}$. As shown, θ' is smaller than the contact angle, θ, formed by the toner 426. Accordingly, the droplet of toner 426' wets a greater surface area of the surface 422 of the medium 420 than the toner 426.

In embodiments, the controller 430 can control the power supply 432 to supply a voltage to the electrical conductor 456 to control wetting of toner over only a portion of the surface 422 of the medium 420, or over the entire surface 422, depending on the desired image(s) to be produced on the medium 420. For example, wetting of the toner on the medium 420 can be altered to affect glossiness and/or coarseness of images. Wetting can be increased to increase glossiness, or not altered to produce matte finishes. Wetting can be controlled at the leading and/or trailing edge of the medium 420 to control printing at these edges. In some embodiments, it may be desirable to have more or less wetting at the leading edge and/or trailing edge than at the center of the medium 420. This wetting control can be achieved by controlling the portion of the medium 420 that is subjected to the electric field, and by the magnitude of the electric field.

It will be appreciated that various ones of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, which are also intended to be encompassed by the following claims.

What is claimed is:

1. A fuser assembly for fusing toner on a medium in a xerographic apparatus, comprising:

a first roll including an electrically-conductive first surface;

an electrically-conductive second surface, the first surface and the second surface defining a nip therebetween at which toner is fused on the medium;

at least one voltage sensor for sensing a first voltage difference between the first surface and the second surface;

at least one power supply connected to the first surface and the second surface; and a controller connected to each voltage sensor and each power supply, the controller receives a signal from each voltage sensor indicating the first voltage difference, and the controller controls each power supply to produce a second voltage difference between the first surface and the second surface based on the first voltage difference.

2. The fuser assembly of claim 1, wherein:

the first roll comprises a first core and an electrically-conductive first outer layer overlying the first core and including the first surface; and the fuser assembly comprises a heated second roll including a second core and an electrically-conductive second outer layer surrounding the second core and having the second surface.

3. A xerographic apparatus comprising a fuser assembly according to claim 2.

4. The fuser assembly of claim 1, further comprising:

a fuser belt comprising an electrically-conductive second outer layer including the second surface; and a second roll and a third roll supporting the fuser belt;

wherein at least one of the second roll and third roll is heated.

5. The fuser assembly of claim 4, wherein the first roll comprises:

a first core; and an electrically-conductive first outer layer overlying the first core and including the first surface.

6. A xerographic apparatus comprising a fuser assembly according to claim 4.

7. The fuser assembly of claim 1, further comprising:

an electrical conductor contacting at least one of the first surface and the second surface; and a separate power supply connected to each respective electrical conductor;

wherein the at least one voltage sensor comprises a first voltage sensor for sensing a first voltage on the first surface and a second voltage sensor for sensing a second voltage on the second surface;

wherein the controller is connected to the first voltage sensor, second voltage sensor and each power supply, the controller receives signals from the first voltage sensor and the second voltage sensor indicating the first voltage and the second voltage, and the controller controls each power supply to produce the second voltage difference between the first surface and the second surface.

8. The fuser assembly of claim 1, further comprising:

an electrical conductor contacting one of the first surface and the second surface, the other of the first surface and the second surface being at ground potential;

the at least one voltage supply is a single power supply connected to the electrical conductor; and the controller is connected to each voltage sensor and the power supply, the controller receives a signal from each voltage sensor indicating the first voltage difference, and the controller controls the power supply to supply power to the electrical conductor to produce the second voltage difference between the first surface and the second surface.

9. A fuser assembly for fusing toner on a medium in a xerographic apparatus, comprising:

a conveyor for conveying the medium;

an electromagnetic wave source for irradiating the medium on the conveyor with electromagnetic waves;

a first electrical conductor downstream from the electromagnetic wave source along the conveyor, the first electrical conductor having a first surface;

a second electrical conductor having a second surface facing the first surface;

at least one voltage sensor for sensing a first voltage difference between the first surface and the second surface;

at least one power supply connected to at least one of the first electrical conductor and the second electrical conductor; and a controller connected to each voltage sensor and each power supply, the controller receives a signal from each voltage sensor indicating the first voltage difference, and the controller controls each power supply to produce a second voltage difference between the first surface and the second surface based on the first voltage difference;

wherein the conveyor is adapted to convey the medium between the first surface and the second surface.

10. The fuser assembly of claim 9, wherein:

a first power supply is connected to the first electrical conductor;

a second power supply is connected to the second electrical conductor;

the controller is connected to the first power supply and the second power supply, and the controller controls the first power supply and the second power supply to produce the second voltage difference between the first surface and the second surface.

11. The fuser assembly of claim 9, wherein:

the power supply is connected to one of the first electrical conductor and the second electrical conductor, the other of the first electrical conductor and the second electrical conductor is at ground potential; and the controller controls the power supply to supply power to the one of the first electrical conductor and the second electrical conductor connected to the controller to produce the second voltage difference between the first surface and the second surface.

12. A xerographic apparatus comprising a fuser assembly according to claim 9.

13. A method of fusing toner on a medium in a xerographic apparatus, comprising:

sensing a first voltage difference between an electrically-conductive first surface and an electrically-conductive second surface spaced from the first surface;

controlling at least one power supply to supply a second voltage difference between the first surface and the second surface based on the first voltage difference;

feeding a medium having molten toner thereon between the first surface and the second surface; and subjecting the medium to the second voltage difference between the first surface and the second surface.

14. The method of claim 13, wherein the second voltage difference is effective to increase wetting of the medium by the molten toner.

15. The method of claim 13, wherein the second voltage difference is effective to maintain the shape of the molten toner on the medium.

16. The method of claim 13, further comprising applying heat and pressure to the medium with the first surface and second surface to fuse the molten toner on the medium.

17. The method of claim 13, wherein:

the first surface is an outer surface of a pressure roll;

the second surface is an outer surface of a fuser roll; and the first surface and the second surface define a nip therebetween.

18. The method of claim 13, wherein:

the first surface is an outer surface of a pressure roll;

the second surface is an outer surface of a fuser belt; and the first surface and the second surface define a nip therebetween.

19. The method of claim 13, further comprising irradiating the medium with electromagnetic waves at a location spaced upstream along the conveyor from the first surface and the second surface, the electromagnetic waves causing the toner to melt.

20. The method of claim 13, further comprising:

sending a signal from at least one voltage sensor indicating the first voltage difference to a controller connected to the power supply;

inputting a desired contact angle of the molten toner on the medium to the controller; and controlling the power supply with the controller to supply power to at least one of a first electrical conductor and a second electrical conductor to produce the second voltage difference between the first surface and the second surface, the second voltage difference being effective to produce the desired toner contact angle on the medium.

* * * * *